United States Patent [19]

Singer

[11] Patent Number: 4,579,168

[45] Date of Patent: Apr. 1, 1986

[54] MAKING METAL STRIP AND SLAB FROM SPRAY

[75] Inventor: Alfred R. E. Singer, Swansea, Wales

[73] Assignee: National Research Development Corp., London, England

[21] Appl. No.: 707,471

[22] Filed: Mar. 1, 1985

[30] Foreign Application Priority Data

Mar. 7, 1984 [GB] United Kingdom ..... 8405982

[51] Int. Cl.[4] ..... B22D 11/06; B22D 23/00

[52] U.S. Cl. ..... 164/480; 164/428; 164/46

[58] Field of Search ..... 164/480, 428, 423, 463, 164/46

[56] References Cited

U.S. PATENT DOCUMENTS 4,114,251 9/1978 Southern et al. ..... 164/46 X
4,420,441 12/1983 Singer .

FOREIGN PATENT DOCUMENTS 55-73448 6/1980 Japan ..... 164/480
57-32854 2/1982 Japan ..... 164/463
57-88951 6/1982 Japan ..... 164/480
1262471 2/1972 United Kingdom .
2115014 9/1983 United Kingdom .

*Primary Examiner*—Kuang Y. Lin
*Attorney, Agent, or Firm*—Cushman, Darby & Cushman

[57] ABSTRACT

In a process for making metal strip 7, a spray 9, 10 of molten metal is directed towards a nip 13 formed by two smooth cooled rolls 6, the rolls being rotated so that the nip hot-compacts the sprayed metal to yield a strip emerging from the exit of the nip. Splats formed by droplets of the molten spray impinging on the rolls 6 before reaching the nip 13 do not stick completely to the roll surfaces but at least partially detach themselves on freezing and form a new surface on which subsequent droplets of the spray land; when the nip is reached, the partially detached frozen droplets and their overlying deposit, on both rolls, are compacted hot.

4 Claims, 1 Drawing Figure

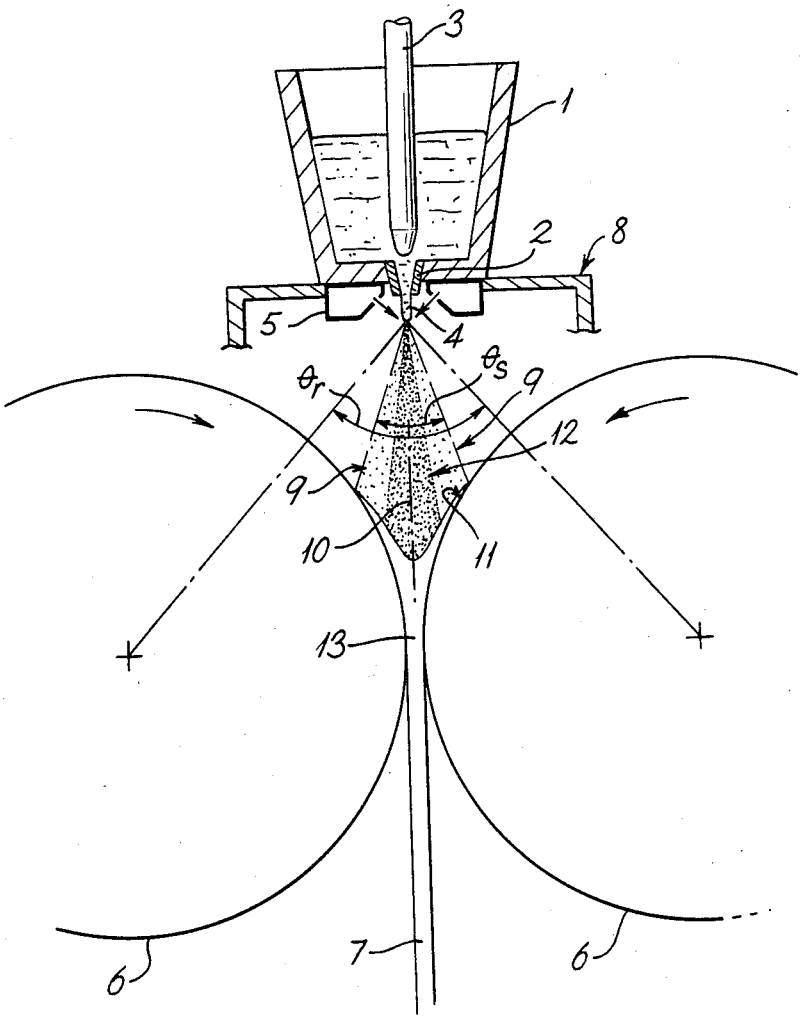
3
1
2
8
5
4
$\theta_r$
$\theta_s$
9
12
9
10
11
13
6
7
6

MAKING METAL STRIP AND SLAB FROM SPRAY

This invention relates to a process for making metal strip and slab from spray.

In UK Patent Specification No. 1262471, a process is described for making metal strip by directing a stream of gas-atomised particles of molten metal on to a substrate, on which the particles coalesce and form a coherent layer, this layer being hot-worked to form the strip.

If this substrate is very smooth, the first particles to land on it will detach themselves under their internal shrinkage stresses as they cool, leading to a very porous layer having insufficient cohesion between the splats for the layer to be removed from the substrate and hot-worked into a strip. On the other hand, if this substrate is very rough, the particles landing on it will attach themselves so securely that the layer cannot be detached when required. Thus, a slightly rough (such as lightly grit-blasted) surface is preferred, and the first particles to land on it will be least likely to detach themselves prematurely if they land substantially orthogonally, hence a further preference, in this known process, for a spray whose axis is at or near 90° to the substrate. The deliberate slight roughness of the substrate is transferred to the deposited layer, which can be made smooth by further working.

The present invention is a process for making metal strip and slab, wherein a spray of molten metal is directed towards a nip formed by two smooth cooled rolls, the rolls being rotated so that the nip hot-compacts the sprayed metal to yield a strip or slab emerging from the exit of the nip. The smooth cooled rolls should be such that splats formed by droplets of the molten spray impinging on the rolls before reaching the nip do not stick completely to the roll surfaces but at least partially detach themselves on freezing and form a new surface on which subsequent droplets of the spray land; when the nip is reached, the partially detached frozen droplets and their overlying deposit, on both rolls, are compacted hot. The angle subtended by the outermost parts of the spray is preferably less than half the angle subtended at the origin of the spray by the axes of the rolls and the centre line of the spray is directed tangentially towards the rolls or not very far off tangentially.

The combination of smooth roller surfaces and the low angle of incidence of the spray leads to splats forming on the moving roll surfaces, freezing and then loosening from the smooth surface at their edges, curling up or even becoming completely detached. Loosened and detached solidified splats are then propelled further into the nip by the movement of the rollers, by their own momentum and (in the case of a gas-atomised spray) by the pressure of the atomising gas. However, their movement in a direction normal to the roll surfaces is constrained by the rapidly tapering gap and the adjacent stream of hot droplets from the centre of the atomised spray. The solidified splats are therefore squeezed between the newly arriving liquid droplets from the centre of the spray and the approaching roll surfaces. The cool solidified splats chill the newly arrived molten droplets causing them to freeze. Immediately afterwards the combined mass is hot-consolidated by the rolls to form a continuous or semi-continuous strip or slab.

This is the only basic configuration in which the use of a smooth or polished substrate works well in spray forming and it is one in which smoothness surprisingly is a positive advantage. A special advantage is that because the splats release themselves from the surface this surface is not continuously subjected to high temperatures or erosion such as would occur with rougher surfaces.

BRIEF DESCRIPTION OF THE DRAWING

The invention will now be described by way of example with reference to the accompanying drawing, which shows apparatus performing a vertical spray casting process.

Molten steel in a heated tundish 1 is formed, by a process according to the invention, into a strip 7 some 20 cm wide and ½ mm thick. The tundish 1 is fitted with an 8 mm-diameter bottom-pouring nozzle 2 and a stopper 3. The molten steel descends from the nozzle 2 as a cylindrical stream 4 to be met by primary atomising jets of nitrogen at 400 $kNm^{-2}$ from a gas atomiser 5, which breaks up the stream 4 into small molten droplets. These are directed downwards by the atomising gas into the nip of a rolling mill having two 600 mm-diameter water-cooled smooth rolls 6 pre-loaded to be able to produce a thin (0.5 mm) steel strip 7 and rotating as indicated at a circumferential speed of 1 m/s.

The process takes place in a chamber 8 which effectively excludes atmospheric air and ensures that the atomised particles are wholly surrounded by nitrogen. The chamber 8 is fitted with seals where it meets the rolls 6. A scanning device is fitted to the atomiser as described in UK Patent Specification No. 1455862 to scan the spray at 50 Hz in a direction normal to the plane of the paper so as to distribute the sprayed particles uniformly axially along the rolls.

The spray of liquid particles in the spray penumbra 9—the parts most deviating from the tangential approach to the rolls—will be less dense (the particles further apart) than in the centre of the spray 10. The outer particles will splat on the smooth roll surface 11, cool extremely rapidly and become at least partly detached from the roll surface thus protecting the roll from the hotter inner particles 12 which will land on top of them pressing them against the roll and also sliding them downwards into the roll nip 13. As the roll continues to turn, these initial splats together with the overlying ones will receive further liquid particles from the centre of the spray 10 after which the combined sandwich is rolled to produce solid strip 7.

The height of the atomiser 5 is such that the angle $\theta_s$ subtended by the spray, being 41°, is less than half the angle $\theta_r$ (84°) subtended where the spray is formed by the axes of the rolls 6.

The formation, size, temperature and speed of particles landing on the rolls has a large random component. Thus some particles will be large and fairly molten while others will be small and already fairly solid. Some will adhere partially to the roll surface, others will detach. The description herein of particle behaviour therefore describes the average particle, not necessarily every particle.

Such factors as the pre-loading of the rolling mill, the roll speed, the reduction given to the spray deposit, the spray feed rate, the roll temperature and cooling rate are all interdependent to an extent. For example, too high a roll speed in relation to the other factors (especially spray feed rate) will produce a porous non-coherent strip. Too low a roll speed in relation to the other factors (especially spray feed rate) will cause molten steel to accumulate in the nip, here it may freeze and stall the mill and in any case will prevent the formation of the fine grain size and non-segregated structure of incrementally solidified spray formed metal that is so desirable in the product (see Metals Technology, February 1983, pages 61–68). While the mill works with the parameters as given earlier, it is highly desirable to have some adjustable control, such as variable spray feed rate or, most preferably, variable roll speed and thickness control either by hydraulic or mechanical means.

Considering the flow of gas from the atomiser 5, spent atomising gas should move away from the area of deposition without carrying with it any wasteful proportion of the spray particles. This is accomplished in two ways which may be used singly or combined.

In the illustrated example, the spray is distributed uniformly along the axial extent of the rolls by a scanning device. The action of scanning has a special advantage in that it allows easy escape of gas in a direction generally parallel to the axes of the rolls. Such scanning action can be oscillatory (i.e. backwards and forwards, reversing direction at the end of such sweep), or it can be unidirectional only. In the latter case the structure of the strip or slab is more uniform and the eflux of gas is mainly in the axial direction and in the sense of the sweep.

Alternatively or additionally, however, we can ensure that spray particles are not wasted, by using a gas pressure and atomising distance such that the spent gas velocities are low in relation to the particles size. This is achieved either by using a relatively low atomising pressure (leading to larger particles and lower gas velocities) or a larger distance between the atomising nozzle and the depositing area (thus attenuating the gas velocities without seriously reducing particle velocities). This distance should not, of course, be so large that $\theta_s$ exceeds $\frac{1}{2}\theta_r$. In any case $\theta_s$ is preferably less than 45°.

Cooling of the rolls is an important element in the operation because in the manufacture of thin strip by the process of the invention part of the latent heat of solidification is absorbed by the rolls. Water cooling internally is advisable and roll surface water cooling may also be necessary, but in this latter case the roll surfaces must be completely dry before being re-presented to the molten metal spray, otherwise undesirable reaction or explosion may occur. In the making of thick strip or slab by the process of the invention, roll cooling is equally necessary but secondary cooling becomes more important, such as by jets of water sprayed on the emerging thick strip or slab.

A second example according to the invention is the horizontal spray casting of a 30 mm thick slab of aluminium alloy 500 mm wide. In this example, the roll gap is set at approximately the thickness of the slab required. A steel starter slab of slightly smaller thickness but similar width is inserted from the withdrawal side between the rotating rolls to a position approximately in the plane containing both roll axes, which plane is vertical, the axes being horizontal. The starter slab has a serrated tongue projecting slightly beyond the line of centres, to ensure that the spray deposit will adhere strongly to it. The stream of molten aluminium alloy is atomised, directed generally horizontally and then scanned (keeping it generally horizontal) so that the centre portion of the spray is directed into the nip approximately tangentially to the rolls, with the outer parts (penumbra) of the spray impacting the roll surfaces at an angle of approximately 40°. The splats formed by the impact of the outer parts of the spray solidify, loosen from the smooth roll surface and are propelled into the nip where they are met by droplets from the centre part of the spray. Any liquid stays where it is, by surface tension. The result is that a partially frozen mass of aluminium alloy approximately 50 mm in thickness accumulates in the nip of the rolls. As the rolls turn this is compacted to form a slab 30 mm in thickness which is withdrawn from the exit side of the mill where it is further cooled by water sprays. For a given feed rate of molten spray the withdrawal rate of the slab is correspondingly small compared with the withdrawal rates of the first example.

Extraction of heat from the aluminium alloy is partly by means of the cooled rolls, partly by cooling of the deposit by radiation and by contact with the relatively cool spent atomising/scanning gas and partly by secondary cooling of the slab by water sprays beyond the exit of the roll nip.

In both the examples given it is assumed that the scanning spray covers the whole axial extent of the rolls and therefore necessarily leads to some overspray. In this case it is beneficial to allow the overspray to cool in flight and solidify to form powder before it impinges on a cold surface. This powder can be collected and re-introduced into the atomiser entrained in the same gas as is used for atomising the liquid stream. Such entrained powder can conveniently be introduced tangentially between the metal stream and the primary atomising nozzles as described in British Patent Publication No. 2115014A. The overspray powder introduced in this way is incorporated into the spray casting and brings the double advantage of improving the overall yield and increasing the cooling rate of the spray casting.

The rolling reduction given during the manufacture of slab may be quite small, say 1 to 5%, in which case it consolidates the surface layers and reduces any porosity in the interior without causing appreciable extension of the slab, or it may be a substantial reduction, as in the second example, causing appreciable plastic deformation and extension of the slab.

An alternative procedure in the case of the spray forming of slabs is to provide edge dams at the edges of the barrel of the rolls. These reduce overspray but need to be moved in the direction of rolling to avoid the accumulation of adherent particles. They also tend to restrict the flow of spent gas away from the deposition area. Ancillary gas jets may be directed at the edges, pointing inwards to reduce overspray but these also tend to interfere with the flow of spent atomising gas.

The two examples show production of strip or slab by spraying into the nip of a rolling mill both vertically downwards and horizontally. Other configurations are also operable, because no substantial pool of molten metal exists at any time in the nip of the rolls, whereby the process operates independently of gravity as far as deposition and compaction are concerned. The freedom given by the absence of a pool of liquid metal enables the process to be so arranged as to feed as conveniently as possible into subsequent manufacturing operations.

Further possibilities are that the rolls need not be of the same diameter, nor need they turn at the same speed as long as they produce strip or slab, nor need they be plain; that is, they may be profiled, for producing profiled strip or slab, as long as their surfaces are functionally smooth. In the case of slab there may be some advantage to be gained by using one roll smaller than the other in which case the strip or slab will exit at an angle inclined towards the smaller roll. This may be useful when it is required to turn the strip or slab into a convenient direction for subsequent rolling, cutting or annealing.

I claim:

1. A process for making metal strip and slab, the steps comprising:

directing a spray of molten metal towards a nip formed by two smooth cooled rolls, the angle subtended by the outermost parts of the spray being less than half the angle subtended by the axes of the rolls at the origin of the spray; and rotating the rolls so that the nip hot-compacts the sprayed metal to yield a strip or slab emerging from the exit of the nip.

2. A process according to claim 1, wherein the rolls are so arranged that droplets of the molten spray impinging on the rolls before reaching the nip form splats which at least partially detach themselves from the rolls on freezing.

3. A process according to claim 1, wherein the centre line of the spray is substantially tangential towards both rolls.

4. Apparatus for making metal strip and slab, comprising two smooth coolable rolls forming a nip, and means for spraying molten metal towards the nip, the angle subtended by the outermost parts of the spray being less than half the angle subtended by the axes of the rolls at the origin of the spray.

* * * * *